United States Patent [19]

Häfele et al.

[11] Patent Number: 4,640,255

[45] Date of Patent: Feb. 3, 1987

[54] FUEL INJECTION PUMP FOR INTERNAL COMBUSTION ENGINES

[75] Inventors: Walter Häfele, Felbach; Manfred Krämer, Schwieberdingen; Dietmar Schmieder, Markgröningen; Johann Warga, Bietigheim-Bissingen, all of Fed. Rep. of Germany

[73] Assignee: Robert Bosch GmbH, Stuttgart, Fed. Rep. of Germany

[21] Appl. No.: 730,616

[22] Filed: May 6, 1985

[30] Foreign Application Priority Data

May 9, 1984 [DE] Fed. Rep. of Germany ..... 3417036
Mar. 16, 1985 [DE] Fed. Rep. of Germany ..... 3509536

[51] Int. Cl.[4] ..... F02M 59/00
[52] U.S. Cl. ..... 123/495; 417/490
[58] Field of Search ..... 123/446, 495; 417/490, 417/494, 499

[56] References Cited

U.S. PATENT DOCUMENTS 4,441,868 4/1984 Fiedler et al. ..... 417/499
4,543,045 9/1985 Ritter et al. ..... 417/499

FOREIGN PATENT DOCUMENTS 74650 3/1983 European Pat. Off. ..... 123/495
2442010 3/1975 Fed. Rep. of Germany ..... 123/495
2442088 3/1975 Fed. Rep. of Germany ..... 123/495
2547071 5/1977 Fed. Rep. of Germany ..... 123/495
3326045 1/1985 Fed. Rep. of Germany .
822261 12/1937 France .
975113 3/1951 France .
2074252 4/1980 United Kingdom .
2042066 9/1980 United Kingdom ..... 123/446

*Primary Examiner*—Charles J. Myhre
*Assistant Examiner*—David A. Okonsky
*Attorney, Agent, or Firm*—Edwin E. Greigg

[57] ABSTRACT

A fuel injection pump for internal combustion engines having a plurality of in-line pumping elements, in which there is one pumping element in the injection pump for each individual combustion chamber of the engine. Each pumping element is surrounded by one partial suction chamber, and quantity dividers inserted into inflow and outflow conduits divide the flow of fuel into partial fuel flows so that each partial suction chamber is flushed, whereby no outflowing fuel is capable of mixing with inflowing fuel.

17 Claims, 8 Drawing Figures

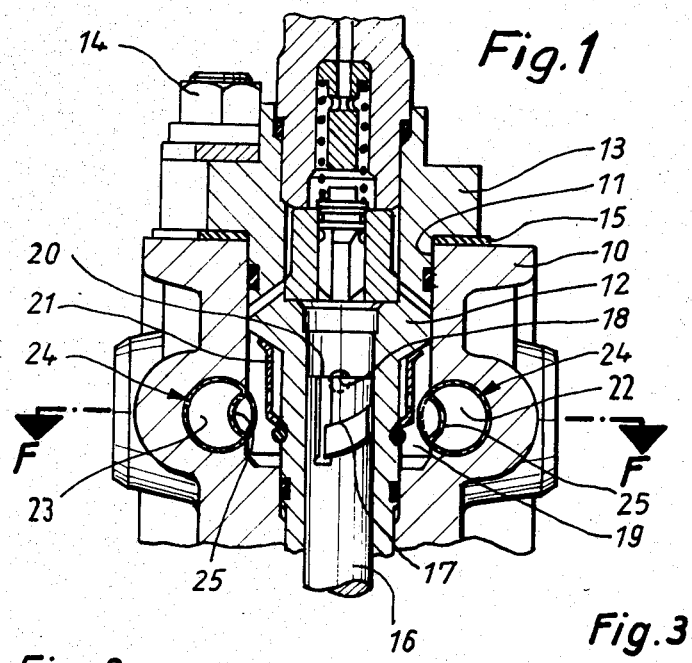
Fig.1
Fig. 2
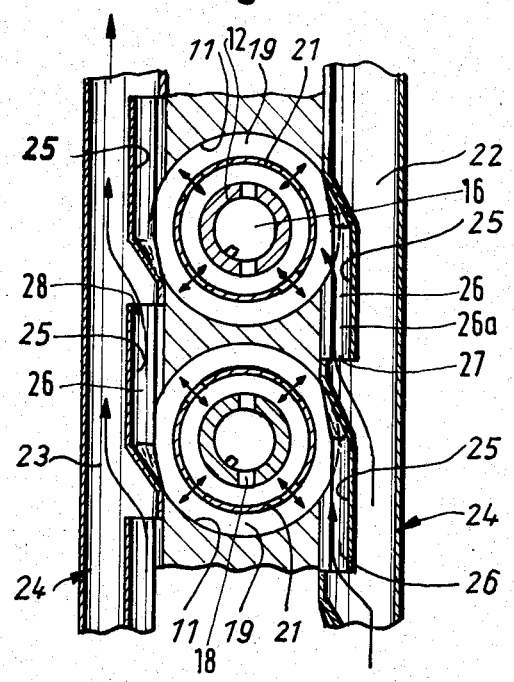
Fig.3a
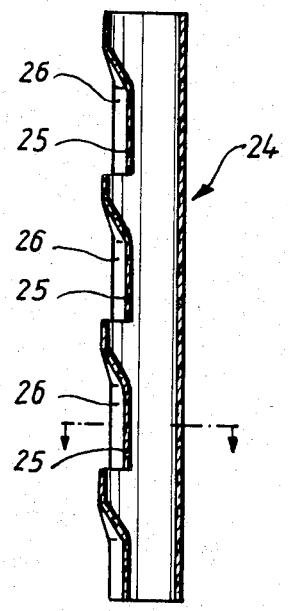
Fig.3b
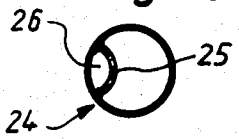

FUEL INJECTION PUMP FOR INTERNAL COMBUSTION ENGINES

BACKGROUND OF THE INVENTION

The invention relates to a fuel injection pump for internal combustion engines as defined hereinafter. Injection pumps in which there is a separate pumping element for each engine cylinder and in which these pump elements are disposed in a row are called in-line injection pumps; they have come into extremely widespread use, especially in self-igniting or so-called Diesel engines. Technological development in such engines is directed to optimizing the course of combustion, in order to meet increasingly stringent exhaust gas regulations, and to reducing the specific weight-to-power ratio. With greatly increased injection pressures, the metered fuel quantity must be very uniform and accurate for each individual pumping element. The fuel metering is effected such that the portion of the fuel that does not result in being injected returns at high pressure into the interior of a collecting chamber of the injection pump. The overflowing of the fuel, which is at high pressure at pump piston control edges causes the fuel to heat up, and hence such physical properties as density and compressibility vary as well, so that both the quantity of fuel metered per pump stroke and its thermal energy content vary, which causes uniform performance by the engine cylinders. For instance, in a high-pressure injection pump designed for a peak pressure of 1200 bar, and with a full-load injection quantity of 150 $mm^3$ per stroke, the result is a return flow quantity 750 $mm^3$ per storke, comprising the diverted fuel quantity plus an overflow quantity returning during the pre-stroke. This heated fuel mixes with the inflowing cold fuel; with conventional injection pumps having a common suction chamber for all the pumping elements, the above-described disadvantages are the result.

In a fuel injection pump of this generic type, known from German Offenlegungsschrift No. 25 47 071, the common suction chamber from which all the pumping elements of the in-line injection pump pump the fuel that is to be metered has already been subdivided into a plurality of partial suction chambers, each of which is associated with one pumping element. Each partial suction chamber has a throttle connection with a common outflow conduit and is supplied from a common inflow conduit. In this known fuel injection pump, however, the outflowing fuel emerging at high pressure and hence heated thereby cannot be prevented from mixing with inflowing fuel in the common inflow conduit, thus causing uncontrollable deviations in the fuel quantities metered in the combustion chambers of the engine.

In order to overcome this disadvantage, the patent application on which German Offenlegungsschrift No. 33 26 045 is based has proposed embodying the partial suction chambers in the form of a hollow cavity entirely surrounding the pump cylinders and communicating with the return flow conduit only via the return flow opening and with the inflow conduit via a throttled inflow opening. The flowthrough cross section of the throttled inflow openings was smaller than the flowthrough cross seotion of the associated return flow openings. Since the heat of the pumping elements and partial suction chambers is also transmitted to the pump housing, the inflowing fuel already heats up while on the way through the pump housing, before reaching the partial suction chambers. The fuel thus assumes ever increasingly higher temperatures as it passes through the pump. This is a further source of errors in fuel quantity, especially because of the influence of temperature when the load point (that is, the quantity of fuel to be injected) is changing. To lessen fuel quantity errors, the following demands were made of the suction chamber system:

Since it is unavoidable that the temperature in the partial suction chambers is dependent on the load point or in other words is not constant, the same temperature should be attained in all of the partial suction chambers;

the modulation behavior of the temperature should be the same for all partial suction chambers;

in the individual partial suction chambers, the flow of heat drawn off with the aid of the scavenging quantity should be of equal magnitude; and the temperature of the pump housing should be at an equal level at each pumping element.

OBJECT AND SUMMARY OF THE INVENTION

The fuel injection pump according to the invention has the advantage over the prior art that there is no mixing of a heated outflow of fuel with the inflowing fuel because the quantity divider divides the inflowing fuel into partial flows, which provide each partial suction chamber with its own fuel flow. Accurate and uniform fuel metering can thus be attained for each combustion chamber of the engine, and the thermal energy content in the quantity of fuel metered per pump stroke is the same for all pumping elements.

An advantageous feature of the invention provides that the quantity dividers are embodied as tubes, which are disposed in the conduits for the fuel flow and have separate inflow and/or outflow openings for each partial suction chamber. In an embodiment of this kind having a separate inflow conduit and a separate outflow conduit, the tubes acting as quantity dividers have pocket-like indentations, which divide the inflowing and outflowing fuel flow, and one pocket-like indentation is disposed in the inflow conduit upstream of each partial suction chamber and another pocket-like indentation is disposed in the outflow conduit downstream of each partial suction chamber. Thus a partial fuel flow, which carries with it the heated outflow fuel, and which delivers fresh inflowing fuel for each pump stroke, flows through each partial suction chamber. This scavenging or flushing effect of the fuel flow can be advantageously exploited further by dimensioning the pocket-like indentations such that they each form a respective additional reservoir for fuel, one preceding and one following the partial suction chambers, on the inflow side and on the outflow side, respectively. The additional reservoir volume serves as a buffer space, so that in the event of recoiling the outflowing fuel cannot reach the inflowing fuel. In dimensioning the pocket-like indentations, the flow speed of the inflowing fuel should also be taken into account.

In another embodiment of the invention, the tubes, or tube, serve as the quantity dividers are subdivided lengthwise into chambers, with separate chambers for the respective inflow and/or outflow of fuel leading to each partial suction chamber. In this embodiment, the chambers in the interior of the tubes, for instance, may be embodied as multi-coil helixes, with one helix coil for the inflow and/or outflow of fuel being associated with each partial suction chamber. The coils in the interior of the tubes may be fabricated of fuel-resistant plastic.

A preferred and particularly advantageous embodiment of the fuel injection pump according to the invention, which is provided with a separate inflow conduit and a separate outflow conduit as taught by the abovementioned German Offenlegungsschrift DE-OS No. 25 47 071, is attained in that at least the one tube inserted into the inflow conduit is fabricated of a nonmetallic material that conducts heat poorly, such as fuel-resistant plastic or ceramic. In order to prevent mixing of the heated outflow fuel with the inflowing fuel in the case of this tube as well, which is made of a material that is a poor conductor of heat, this tube has pocket-like recesses adjoining each partial suction chamber at a tangent and each communicating via a respective throttling inflow opening with a longitudinal conduit in the tube. Each of these recesses acts as an additional reservoir, preceding the partial suction chamber, for the fuel flowing back out of the overflow opening of the pump cylinder. Now, in order to assure uniform, thorough scavenging or flushing of the partial suction chambers despite the flow resistances that come into play in the longitudinal conduit, the throttling inflow openings discharging into the reservoirs become increasingly larger—as viewed in the flow direction—so that each flowthrough cross section of the inflow opening that is next in the flow direction, as seen from the inflow conduit inlet, is larger, by an amount that compensates for flow losses, than the flow cross section of the immediately preceding inflow opening. These inflow openings provided with different flow cross sections have already been proposed per se in the German patent application (DE-OS No. 33 26 054), mentioned above, of the present applicant.

To assure that not only the quantity, but also the speed, of the fuel flowing through all the partial suction chambers will adjust to the same value, in a preferred embodiment of the invention the longitudinal conduit inside the tube inserted into the inflow conduit is embodied as a stepped bore, with a respective conduit segment associated with each inflow opening; the flow cross section varies from each conduit segment to the next, and the flow cross section of the last conduit segment, that is, the one most remote from the inlet of the inflow conduit, is equal to or slightly larger than the flow cross section of the associated inflow opening.

To improve the durability of the above tubes in heavy-duty pumps, the inner walls of the recesses receiving the reservoirs can be armored via an erosion-resistant, preferably metal lining.

Now, in order to prevent excessive heating of the pump housing, however, the tube inserted into the outflow conduit is fabricated of a material that is a good conductor of heat, for instance aluminum. This tube, like the tube located in the inflow conduit, is also provided with recesses embodied by indentations, each embodying a reservoir following its associated partial suction chamber. Because the fuel accordingly takes a variable length of time to travel through the pump, the tube inserted into the outflow conduit can preferably be disposed in the direction counter to the flow, to prevent non-uniform heating of the fuel.

The invention will be better understood and further objects and advantages thereof will become more apparent from the ensuing detailed description of preferred embodiments taken in conjunction with the drawings.

BRIEF DESCRIPTION OF THE DRAWINGS

FIG. 1 is a fragmentary cross section taken through the first exemplary embodiment of a fuel injection pump, having a first embodiment of the quantity divider according to the invention;

FIG. 2 is a portion of a longitudinal section taken along the line F—F of FIG. 1;

FIGS. 3*a* and 3*b* are a longitudinal cross section and an end cross section, respectively, of the quantity divider according to the invention as shown in FIGS. 1 and 2;

DESCRIPTION OF THE PREFERRED EMBODIMENTS

Figure 4:
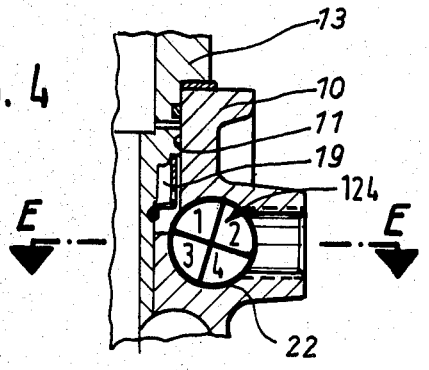
FIG. 4 is a fragmentary cross section taken through an injection pump having a quantity divider in a second embodiment.

In the longitudinal section shown in FIG. 1, a receiving bore 11 for a pump cylinder 12 is located inside a pump housing 10. The pump cylinder 12 widens out into a securing flange 13 at the top. The securing flange 13 is fastened by means of screws 14 to the pump housing 10. A shim 15, inserted between the securing flange 13 and the pump housing 10, serves in a known manner to adjust the pre-stroke. A pump piston 16 operates inside the pump cylinder 12, and its control edge 17 cooperates with an overflow opening 18 in the pump cylinder 12 in order to meter fuel. The overflow opening 18 leads into a partial suction chamber 19 and simultaneously acts as an intake opening. The pump piston 16 both reciprocates and rotates and it has a second control edge 20 which determines the supply onset of the fuel by covering the overflow opening 18. To prevent the outflow fuel, which is diverted under high pressure and flows back into the partial suction chambers 19 from causing erosion of the wall of the receiving bore and of the surface of the pump cylinder 12 because of its high kinetic energy, an impact ring 21 is provided. Fuel is supplied through an inflow conduit 22 and excess fuel can flow out via an outflow conduit 23. The inflow conduit 22 and the outflow conduit 23 contain a tube 24 which acts as the quantity divider, shown more clearly in FIGS. 2 and 3*a* and having pocket-like indentations 25. The pocket-like indentations 25 in the inflow conduit 22 divert a portion of the fuel flow and direct it into the associated partial suction chambers 19, thereby forming preceding additional reservoirs 26 for the fuel, bringing about a buffer effect and preventing outflowing fuel from reaching the inflow conduit 22; instead, all the fuel is flushed out through the partial suction chambers 19. On the other hand, heated fuel cannot be reaspirated by the pumping element from the outflow conduit 23, since the additional reservoirs 26 of the outflow conduit 23 are disposed downstream of and following the partial suction chambers 19. The quantity of the inflowing fuel and the flow cross sections in the conduits must be dimensioned such as to assure complete flushing of the partial suction chambers 19 and such that the entire amount of overflow fuel is received by the outflow conduit 23.

This flushing or scavenging effect is also shown in FIG. 2, in which arrows indicate the fuel flow. FIG. 3*a* is a longitudinal section taken through the tube 24 having the pocket-like indentations, and FIG. 3*b* is a cross section thereof. The quantity dividers in both the inflow conduit 22 and the outflow conduit 23, embodied as tubes 24, are identical in design but are inserted in opposite directions in accordance with the fuel flow.

Each tube 24 that is inserted into the inflow conduit 22 has a respective inflow opening 27 in the upstream end portion 26*a* of the reservoir 26; in the other tube 24, which is inserted into the outflow conduit 23, the corresponding sheared-off downstream edges of the indentations 25, which also encompass the reservoirs 26 there, each form a respective outflow opening 28.

FIG. 4 shows half a cross section through an injection pump having the characteristics of the second exemplary embodiment. In this exemplary embodiment, the inflow conduit 22 and outflow conduit 23 (see also FIG. 5*a*) each have a quantity divider embodied by a tube 124, which has a separate chamber in the fuel flow direction for the inflow and outflow of the fuel for each pumping element.

Figure 5A:
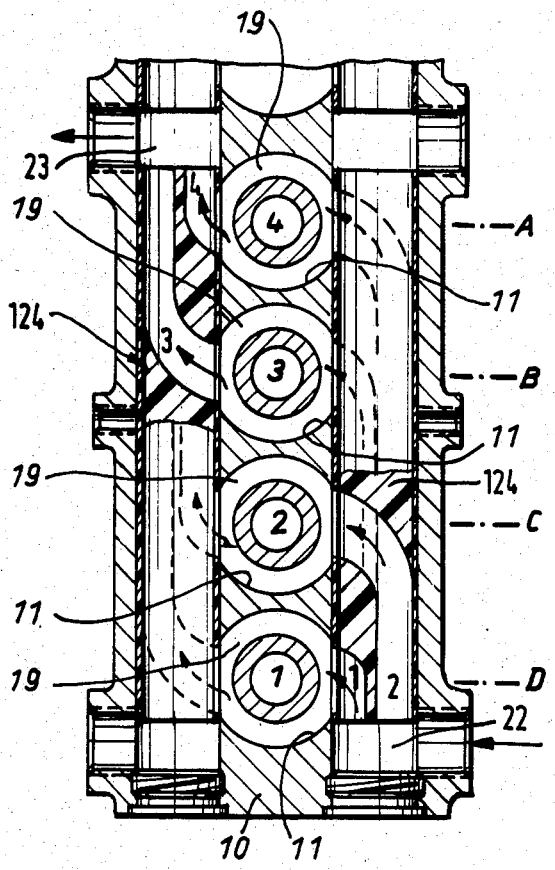
FIGS. 5*a* and 5*b*, which are also fragmentary views, serve to explain the exemplary embodiment of the quantity divider of FIG. 4 in greater detail.

FIG. 5*a* is a fragmentary longitudinal section taken along the line E—E of FIG. 4. In order to attain effective flushing of the partial suction chambers 19, four separate flow zones are provided and identified by the numerals 1–4. Each flow zone belongs to one partial suction chamber 19 of a pumping element of an in-line injection pump; the associated pumping elements are shown in simplified form and also identified by the numerals 1–4.

Figure 5B:
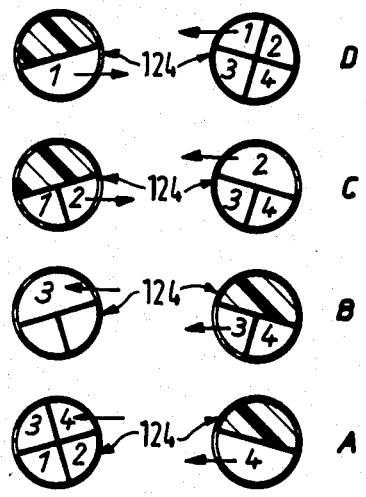

The shape of the cross sections of the tubes 124 of the quantity divider according to FIG. 5*a* is shown in FIG. 5*b*. There the sections A–D represent the cross sections taken through the one tube 124 in the inflow conduit 22 (see the right-hand row) and to the left of them, the associated cross sections of the other tube 124 in the outflow conduit 23 are shown. The arrows again indicate the flow of fuel to and from the partial suction chambers 19.

The fragmentary cross section shown in FIG. 4 may also belong to a different exemplary embodiment, not shown in detail, having only one tube 124. This tube 124 is divided lengthwise into chambers associated with the flow zones 1, 2, 3, 4. These chambers are embodied in the interior of the tube 124 as multiple-coil helixes (helical conduits), one coil of the helix for the inflow and/or outflow of the fuel being associated with each partial suction chamber. The multiple-coil helixes in the interior of the tube 124 can be fabricated of fuel-resistant plastic, and either they are divided lengthwise by a partition into a respective first chamber for the inflow of the fuel and a second chamber provided for the outflow of the fuel, or else two tubes are again provided, as in the other exemplary embodiments, one being for the inflow and the other for the outflow of the fuel.

Figure 6:
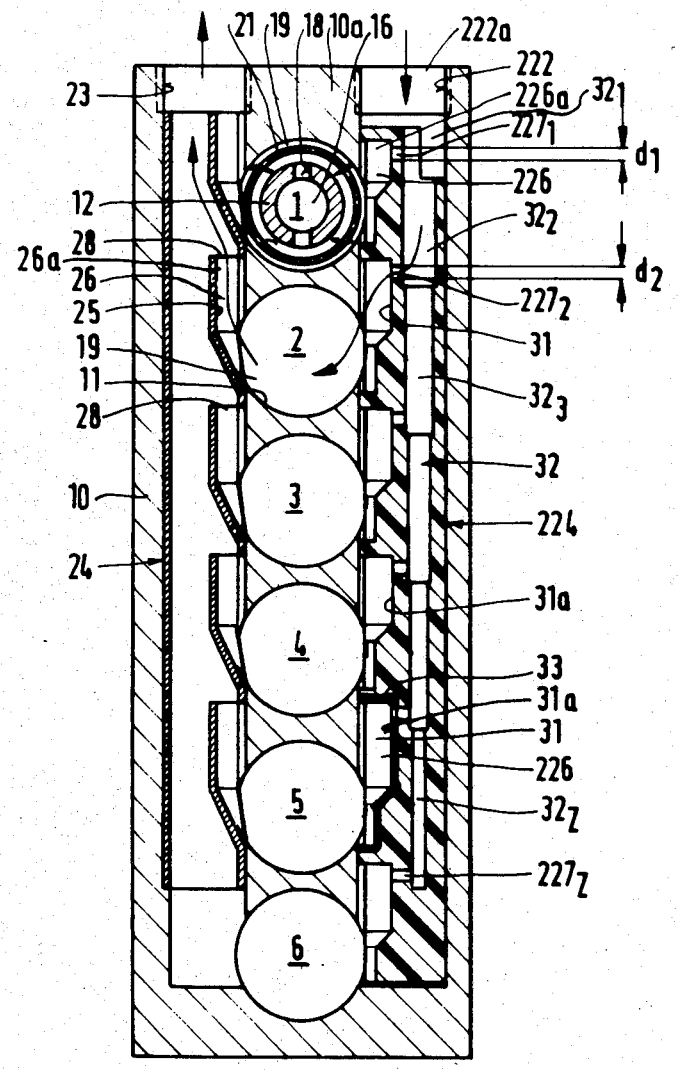
FIG. 6 is a longitudinal cross section, corresponding to FIG. 5*a*, taken through the third exemplary embodiment.

FIG. 6 is a simplified longitudinal cross section, corresponding to FIG. 5*a*, at the level of an inflow conduit 222 or of the outflow conduit 23, but for a third exemplary embodiment of the fuel injection pump according to the application. This fuel injection pump is a six-cylinder injection pump, in which the pump cylinders 12 or partial suction chambers 19 associated with the various flow zones are identified successively by the numerals 1–6. For the sake of clearer illustration, the pumping elements associated with flow zones 2–6 have been omitted in the sectional view.

A tube 224 inserted into the inflow conduit 222 comprises a nonmetallic material that is a poor thermal conductor, for instance fuel-resistant plastic or ceramic, and the tube 24 inserted into the outflow conduit 23 corresponds to the tube used in the first exemplary embodiment. This tube 24 may also be fabricated in plastic for the sake of thermal insulation; for the sake of removing heat better, however, it is fabricated of some material that is a good thermal conductor, for instance aluminum. Like the tube 24 used in the example described in conjunction with FIGS. 1–3, it has pocket-like indentations 25 adjoining each partial suction chamber 19 at a tangent, each indentation 25 forming a reservoir 26 following its associated partial chamber 19. This chamber 26 discharges into the interior of the tube 24 via the outflow opening 28 located in its downstream end zone 26*a*.

To compensate for the variable heating time of the fuel corresponding to the variably long inflow route inside the tube 224, the outflowing fuel is guided in the counterflow direction through the tube 24. This tube 24 located in the outflow conduit 23 is therefore inserted in the opposite flow direction from the flow direction of the tube 224 inserted into the flow conduit 222, with its outflow openings 28 pointing toward the housing segment 10*a*which receives the inlet 222*a* of the inflow conduit 222.

The tube 224 includes a longitudinal conduit 32 and recesses 31, which embody reservoirs 226 and communicate with the longitudinal conduit 32 via inflow openings $227_1$, $227_2$–$227_Z$. The longitudinal conduit is embodied as a stepped bore, having one conduit segment $32_1$, $32_2$–$32_Z$ associated with each inflow opening $227_1$, $227_2$–$227_Z$. The subscripts indicate the association with the respective flow zone, and the letter Z stands for the last flow zone as viewed in the flow direction. In the exemplary embodiment of FIG. 6, in other words, Z stands for flow zone 6. Each of the conduit segments, such as $32_2$, which follows a preceding conduit segment, such as $32_1$, in the flow direction has a flow cross section that is reduced in comparison with the one preceding it, and the flow cross section of the last conduit segment $32_Z$, that is, the most remote from the inlet 22*a* of the inflow conduit 222, is at least equal to, or slightly larger than, the flow cross section of the associated inflow opening $227_Z$.

If the associated fuel injection pump operates at very high injection pressures and correspondingly large outflow quantities and high outflow speeds, then erosion and cavitation can occur on the inner walls 31*a* of the recesses 31, when the tube 224 inserted into the inflow conduit 222 is made of plastic. In such cases, the inner walls 31*a* of the recesses 31, which surround the reservoirs 226 on three sides, can be armored, each wall with its own erosion-resistant, preferably metal lining 33. The drawing shows a lining of this kind for the reservoir 226 associated with the flow zone 5. If the tube 224 is a plastic injection molded part, then the linings 33 can be placed in the injection molding tool as sheet metal inlay parts and they are then subsequently firmly joined to the tube 224. A method of this kind can also be used with ceramic materials.

The pocket-like recesses 31 adjoining each partial suction chamber at a tangent 19 are open toward the partial suction chamber 19 and communicate with the longitudinal conduit 32 in the tube 224, each via one of the throttling inflow openings 227; these recesses 31 direct a partial flow of fuel, diverted from the inflowing fuel flow, to each partial suction chamber 19. Thus each of the recesses 31 forms one of the additional reservoirs 226 preceding the associated partial suction chamber 19, these reservoirs 226 being intended for fuel flowing back from the overflow opening 18 of the pump cylinder 12. By means of the inflow openings 227, each upstream end portion 226*a* of each reservoir 226 is connected to the longitudinal conduit 32. Because of this shape and location of the reservoirs 226, even fuel that is at a high injection pressure and is emerging at a high flow speed cannot be forced so far backward that it could mix with the inflowing fuel in the longitudinal conduit. In the intervals between injections, the fuel diverted following the previous supply stroke is pumped back to the tank via the reservoir 26 of the tube 24 located in the outflow conduit, by means of the excess fuel bypassing the partial suction chambers 19.

Although a largely uniform flow through the partial suction chambers 19 is already attained because of the inflow openings $227_1$–$227_Z$, which become larger and larger in the flow direction, a completely uniform heating of the fuel and thus the required supply of equal amounts of fuel to the pumping elements cannot be attained except by combining all of the features described in connection with FIG. 6, in their entirety.

This combination is as follows: the disposition of the reservoirs 226 located preceding the partial suction chambers 19; the bores of the inflow openings $227_1$–$227_Z$ which increase in diameter, and the diameters which decrease stepwise in the flow direction of the conduit segments $32_1$–$32_Z$ of the longitudinal conduit 32; the tube 224 fabricated of material that is a poor thermal conductor, in combination with the tube 24 in the outflow conduit, this tube 24 being of a material that conducts heat well; and the outflow conduit that likewise has reservoirs 26, but in this case disposed following the partial suction chambers 19.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines, comprising a plurality of pump cylinders disposed in line in reception bores of a pump housing, each of said pump cylinders arranged to receive a pump piston provided with control edges to determine the duration of injection, said pump cylinders further being surrounded by partial suction chambers and arranged to communicate with said partial suction chambers by means of overflow openings, inflow and outflow conduits disposed parallel to a camshaft of said engine for fuel flow into and out of said partial suction chambers, quantity dividers positioned in said inflow conduits and said outflow conduits for fuel flow and said quantity dividers adapted to allocate to each said partial suction chamber a separate partial flow of fuel.

2. A fuel injection pump as defined by claim 1, further wherein said quantity dividers comprise tubes which are inserted into said inflow conduits and said outflow conduits, each said tube including separate at least one of said inflow openings and said outflow openings for each partial suction chamber.

3. A fuel injection pump as defined by claim 2, further wherein said tubes are subdivided lengthwise into chambers, with separate chambers for at least one of said inflow and outflow of fuel leading to each said partial suction chamber.

4. A fuel injection pump as defined by claim 3, further wherein said chambers in said tubes are embodied as multiple-coil helixes, each said partial suction chamber being allocated one helix coil for at least one of said inflow and outflow of fuel.

5. A fuel injection pump as defined by claim 4, further wherein said multiple-coil helixes are positioned in an interior zone of said tubes and said helixes are fabricated of fuel-resistant plastic.

6. A fuel injection pump as defined by claim 2, including a separate inflow conduit and a separate outflow conduit, further wherein said tubes include pocket-like indentations which divide the inflowing and outflowing fuel flow, and that each said partial suction chamber is preceded upstream by a pocket-like indentation in said inflow conduit and is followed downstream by a pocket-like indentation in said outflow conduit.

7. A fuel injection pump as defined by claim 6, further wherein said pocket-like indentations are dimensioned such that each pocket-like indentation forms selectively at least one of an additional preceding and following reservoir for fuel on at least one of the inflow side and the outflow side, respectively.

8. A fuel injection pump as defined by claim 2, including a separate inflow conduit and a separate outflow conduit, further wherein at least one of said tubes which is inserted into said inflow conduit is fabricated of a nonmetallic material that is a poor thermal conductor, for instance fuel-resistant plastic.

9. A fuel injection pump as defined by claim 2, including a separate inflow conduit and a separate outflow conduit, further wherein at least one of said tubes which is inserted into said inflow conduit is fabricated of a nonmetallic material that is a poor thermal conductor, for instance fuel-resistant ceramic.

10. A fuel injection pump as defined by claim 8, further wherein one of said tubes inserted into said inflow conduit has pocket-like recesses which adjoin each said partial suction chamber at a tangent, said recesses further being open toward said partial suction chamber and arranged to communicate via a respective inflow opening with a longitudinal conduit in said tube, said recesses further arranged to direct a partial flow from said inflowing fuel flow to each said partial suction chamber and each said recess adapted to form one additional reservoir preceding the associated partial suction chamber for fuel returning from said overflow opening of said pump cylinder, and further that by means of said inflow openings a respective upstream end portion of each reservoir is connected to said longitudinal conduit.

11. A fuel injection pump as defined by claim 9, further wherein one of said tubes inserted into said inflow conduit has pocket-like recesses which adjoin each said partial suction chamber at a tangent, said recesses further being open toward said partial suction chamber and arranged to communicate via a respective inflow opening with a longitudinal conduit in said tube, said recesses further arranged to direct a partial flow from said inflowing fuel flow to each said partial suction chamber and each said recess adapted to form one additional reservoir preceding the associated partial suction chamber for fuel returning from said overflow opening of said pump cylinder, and further that by means of said inflow openings a respective upstream end portion of each reservoir is connected to said longitudinal conduit.

12. A fuel injection pump as defined by claim 10, further wherein a flow cross section of a particular inflow opening is larger than a flow cross section of said inflow opening preceding it.

13. A fuel injection pump as defined by claim 10, further wherein said longitudinal conduit further comprises a stepped bore having one conduit segment associated with each said inflow opening, each of said conduit segments arranged to adjoin a preceding conduit segment in the flow direction further including a reduced flow cross section as compared with the flow cross section of said preceding conduit segment, and further that said flow cross section of said last conduit segment is at least equal to or larger than said flow cross section of said associated inflow opening.

14. A fuel injection pump as defined by claim 11, further wherein said longitudinal conduit further comprises a stepped bore having one conduit segment associated with each said inflow opening, each of said conduit segments arranged to adjoin a preceding conduit segment in the flow direction further including a reduced flow cross section as compared with the flow cross section of said preceding conduit segment, and further that said flow cross section of said last conduit segment is at least equal to or larger than said flow cross section of said associated inflow opening.

15. A fuel injection pump as defined by claim 10, further wherein pocket-like recesses further include inner walls which are armored by means of a respective erosion-resistant, preferably metallic lining.

16. A fuel injection pump as defined by claim 8, further wherein said tube inserted into said outflow conduit is fabricated of a material that is a good thermal conductor, preferably aluminum, said tube further including pocket-like indentations adjoining each said partial suction chamber at a tangent, each said pocket-like indentation arranged to form one reservoir following said associated partial suction chamber and said reservoir arranged to discharge via said outflow opening located in its downstream end portion, into said tube.

17. A fuel injection pump as defined by claim 16, further wherein said tube in said outflow conduit further includes a flow direction which is counter to the flow in said inflow conduit, said outflow openings in said outflow conduit arranged to extend toward an end of said housing which is adapted to receive an inlet of said inflow conduit.

* * * * *